United States Patent [19]

Vajdic et al.

[11] Patent Number: 4,727,309

[45] Date of Patent: Feb. 23, 1988

[54] CURRENT DIFFERENCE CURRENT SOURCE

[75] Inventors: Branislav Vajdic, Santa Clara; Stephen L. Smith, Sunnyvale, both of Calif.

[73] Assignee: Intel Corporation, Santa Clara, Calif.

[21] Appl. No.: 5,942

[22] Filed: Jan. 22, 1987

[51] Int. Cl.[4] ..... G05F 3/16

[52] U.S. Cl. ..... 323/315; 323/312

[58] Field of Search ..... 323/312, 315, 316

[56] References Cited

U.S. PATENT DOCUMENTS

| | | | |
|---|---|---|---|
| 4,283,673 | 8/1981 | Lieux | 323/316 |
| 4,399,399 | 8/1983 | Joseph | 323/316 |
| 4,550,262 | 10/1985 | Kohsiek | 323/315 |

*Primary Examiner*—Patrick R. Salce
*Assistant Examiner*—Jeffrey Sterrett
*Attorney, Agent, or Firm*—Blakely, Sokoloff, Taylor & Zafman

[57] ABSTRACT

A current difference current source which provides a stable current as operating conditions change. Two MOS transistors operate as two current sources. A difference current is obtained by subtracting the two transistor currents. The two current sources are configured to vary similarly as conditions change, such that their difference remains constant. In the alternative the difference current is forced to decrease as current increases in the transistors, wherein a reverse compensated current is provided. The difference current is used to drive a current mirror which functions as a compensated current source.

16 Claims, 8 Drawing Figures

CURRENT DIFFERENCE CURRENT SOURCE

BACKGROUND OF THE INVENTION

1. Field of the invention

The present invention relates to a field of solid state current sources.

2. Related Application

The present application is related to a copending U.S. patent application Ser. No. 005,941, filed Jan. 22, 1984, entitled "Current Controlled Solid State Switch" and is incorporated herein by reference to provide a teaching of operating conditions encountered by MOS transistors and examples of certain applications.

3. Prior Art

In the design of solid state circuits and devices utilizing MOS technology, a stable current source is a necessary requirement in many applications. For a current source to be ideal, it must be independent of operating condition variations, such as changes in temperature, supply voltage, device parameter variations and etc. Although complex circuits can be designed to provide such a stable current source, economics or physical constraints may present prohibitive constraints.

A typical MOS transistor operating in the saturation region is a simple form of a current source. However, a transistor is susceptible to operating condition changes, including its own process variations. These changes will result in the transistor sourcing higher current as temperature decreases, supply voltage increases or process variations causing the transistor to operate in the higher saturation current region. The problem is compounded when all extreme conditions occur simultaneously.

It is appreciated that what is needed is a simply designed current source which is compensated to provide a stable and desired output even as operating conditions change.

SUMMARY OF THE INVENTION

The present invention provides for an apparatus and a method for providing a compensated current source. Two current sources are used wherein the compensated current is derived from the difference of the two current sources. These two current sources can have different responses to changes in operating conditions.

An embodiment of the present invention uses MOS transistors as current sources. A first and second transistor are coupled in series and a third transistor representing the compensated current source is coupled in parallel to the second transistor, such that the current flow through the third transistor is determined by the difference of the first and second transistors currents.

A resistor is used in one embodiment and a transistor in another to provide feedback to one of the current sources so that the first and second transistors will have slightly different characteristics to provide the difference current for the compensated current. In another embodiment, the difference current is made to have a reverse compensation effect, wherein the slope of the response characteristic of the compensated current is opposite to that of a typical MOS transistor.

A current mirror configuration is used to couple the third transistor to a fourth transistor. The third transistor operating as the driving transistor of the current mirror.

DETAILED DESCRIPTION OF THE INVENTION

The present invention provides for an apparatus and a method for providing a compensated current source in a semiconductor device. In the following description, numerous specific details are set forth such as specific circuits, graphic representations, etc., in order to provide a thorough understanding of the present invention. It will be obvious, however, to one skilled in the art that the present invention may be practiced without these specific details. In other instances, well-known circuits and processes have not been described in detail in order not to unnecessarily obscure the present invention.

Figure 1:
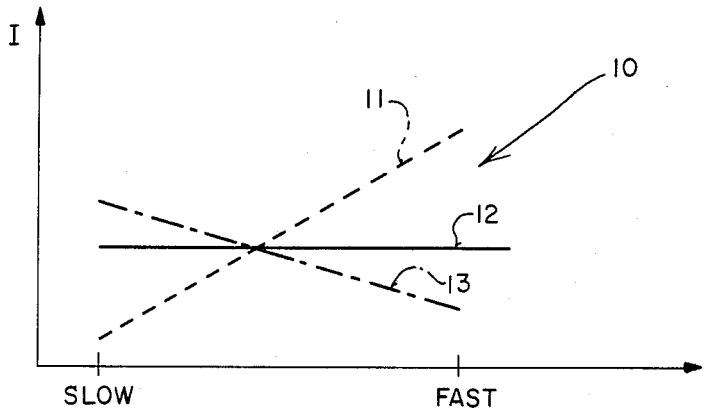
FIG. 1 is a graph showing various response characteristics showing MOS transistor current variations due to operating condition changes.

Referring to FIG. 1, a graph of current versus operating conditions is shown. A MOS transistor biased in the saturation region of its operating curve exhibits a fairly steady current value such that the MOS transistor can be utilized as a current source. However, such transistors retain parameter characteristics which are subject to changing external environment and to process variations within each transistor device. Conditions such as temperature, supply voltage (Vcc) and the value of the saturation current will cause performance of the transistor to vary considerably. Such condition variations involving fast and slow transistor response are disclosed in the above-mentioned copending application.

FIG. 1 shows a response of a typical MOS transistor biased in the saturation region to function as a current source. Graph 10 of FIG. 1 shows three curves 11, 12 and 13. Curve 11 represents a typical MOS transistor characteristic response. The horizontal axis of graph 10 represents various operating conditions encountered by the MOS transistor. Traveling along the horizontal axis from the origin, the response characteristic of a MOS transistor transitions from a slower to a faster operating condition. A combination of the external environment and internal process variations of a MOS transistor operate to vary the performance characteristic of the transistor. Slowest transistor condition occurs when high temperature, low supply voltage, and low saturation current are encountered by the transistor operating as a current source. The fastest condition occur when low temperature, high supply voltage and high saturation current are encountered.

At the slower condition the value of the transistor current as represented by the vertical access of graph 10 is at a lower value. At the faster conditions the transistor current is at a higher value as shown by graph 11. Therefore, using a MOS transistor which is biased in the saturation region as a current source, its current will vary appreciably as transistor operating conditions change. Ideally, what is desired is a steady current which is independent of the changes occurring to the operating conditions. Such an ideal response is shown by curve 12.

Curve 13 shows a reverse compensated case. Reverse compensation occurs when higher current is experienced at slower conditions and the value of the saturation current decreases as the operating condition shifts to a faster condition. An object of the present invention is to provide a compensated current source exhibiting approximately the characteristic shown in curve 12 or alternatively, to provide a reverse compensated case as shown in curve 13. One such use of a compensated current source is discussed in the above-mentioned copending application.

Figure 2:
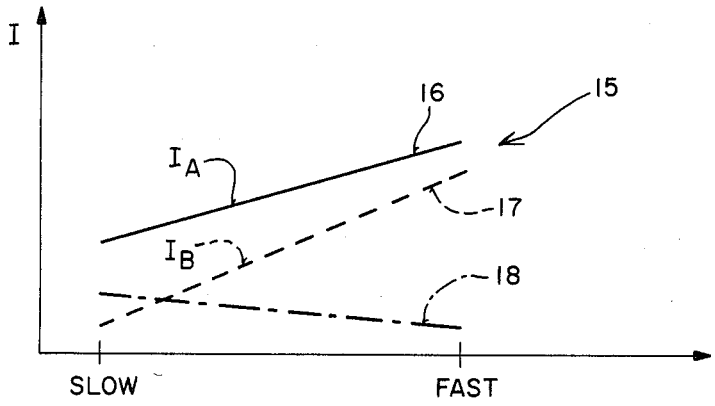
FIG. 2 is a graph of two MOS current source characteristic response showing current variations as operating condition changes and also showing a difference current.

Referring to FIG. 2, graph 15 shows current verses transistor operating conditions of three curves 16–18. An object of the present invention is to utilize two current sources which have different response characteristics and to obtain a compensated current source by using the difference of the two original current sources. Curves 16 and 17 illustrate a response of two separate MOS transistor current sources.

As described in FIG. 1, a typical MOS transistor operating in a saturation region has the response characteristic of lower current at slower conditions and higher current at faster conditions. Therefore, a first current source having a performance response as shown by graph 16 and a second current source as shown by curve 17 exemplify two different transistor responses. A difference of the two curves 16 and 17 results in the response as shown by curve 18. By carefully orchestrating the response of curves 16 and 17 representing the two current sources, curve 18 can be made to approximate a desired response, such as curve 12 or 13 of FIG. 1.

In FIG. 2, a first current $I_A$ as represented by curve 16 changes at a slower rate as operating conditions change than a second current $I_B$ represented by curve 17. Negative feedback or a number of other well-known techniques can be used to obtain desired slope of curve 16. The current difference current source of the present invention uses the difference of these two currents $I_A$ and $I_B$.

Figure 3:
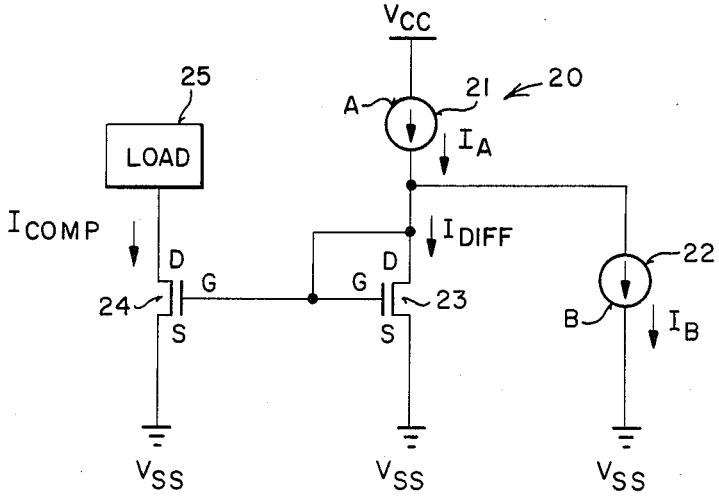
FIG. 3 is a circuit schematic diagram showing a circuit implementation of the present invention.

Referring to FIG. 3, a circuit implementation of the present invention is shown. Circuit 20 is comprised of current mirror transistors 23 and 24 and current sources 21(A) and 22(B). Transistors 23 and 24 are arranged as a current mirror, wherein transistor 24 is the driving transistor and transistor 23 is the mirroring transistor. The gates of transistor 23 and 24 are coupled together, as well as to drain of transistor 23. Drain of transistor 24 is coupled to block 25. Sources of transistors 23 and 24 are coupled to Vss, which in this case is ground.

Current source 21 labeled $I_A$ is placed in series with transistor 23 such that current source 21 is serially coupled between drain of transistor 23 and supply voltage, Vcc. Current source 22 is coupled to drain of transistor 23 such that current source 22 is in parallel to transistor 23. Transistors 23 and 24 operate as a current mirror wherein the current flow through transistor 24 is a weighted replication of the current flow through transistor 23. Current flow through transistor 23 is labeled $I_{diff}$ and current flow through transistor 24 is labeled $I_{comp}$. Transistor 24 is coupled to circuit 25. Circuit 25 may be a variety of circuits which can be driven by transistor 24. One such example of a circuit of block 25 is the current controlled switch of the above-mentioned copending application. Operation of a current mirror is well-known in the prior art.

Applying Kirchoff's current Law the current $I_{diff}$ is equal to $I_A$–$I_B$. Therefore, $I_{diff}$ is the difference of current source $I_A$–$I_B$. The current $I_{comp}$, being a weighted value of current $I_{diff}$, is equivalent to $k(I_A-I_B)$, wherein k is a constant. Thus $I_{comp}$ is also equivalent to a difference of two currents sources $I_A$–$I_B$.

Assuming that current sources 21 and 22 are MOS transistors operating in a saturation region and further current sources 21 and 22 exhibit characteristics described in FIG. 2. If current source 21 is designed to have a response similar to that of curve 16 and current source 22 is made to have a current response equivalent to that of curve 17 of FIG. 2, then current $I_{diff}$ will be equivalent to curve 18 of FIG. 2.

It is appreciated that although the curves 16–18 are shown in straight lines, actual MOS transistor characteristics will not exhibit such straight line response. Typical nonlinear response of transistor characteristic will present nonlinear current response. However, the description of the present invention attempts to approximate various nonlinear characteristics of MOS transistors by providing a close linear approximation for ease of explanation. It is also appreciated that with the proper design choice in selecting current sources 21 and 22, curve 18 can be made to respond with an approximately zero slope such that the difference current $I_{diff}$ will be a constant no matter the operating condition imposed on the transistors.

Figure 4:
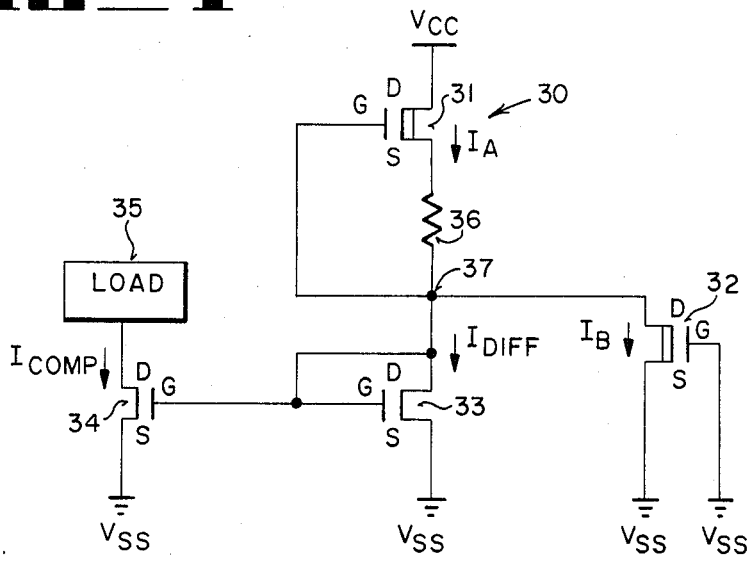
FIG. 4 is an embodiment of the present invention wherein depletion type transistors are used for current sources A and B, a resistor is used as a feedback means.

Referring to FIG. 4, one embodiment of the present invention is shown as circuit 30. Transistors 33 and 34 are configured and function equivalently to transistors 23 and 24 of FIG. 3 to set a compensating current $I_{comp}$ to block 35. The drain of transistor 33 is coupled to node 37. Current source A is represented by transistor 31 and resistor 36; and transistor 32 represents current source B as was described with the current sources 21 and 22 of FIG. 3. Transistor 31 is a depletion type device having its drain coupled to Vcc and its gate coupled to node 37. Transistor 32 is also a depletion device having its drain coupled to node 37 and its source and gate coupled to Vss, which in this case is ground.

A resistor 36, coupled between source of transistor 31 and node 37, serves as a source degeneration resistor providing negative feedback to the gate of transistor 31. Resistor 36 provides the necessary feedback which places a limitation on the rate of change of current of transistor 31. In effect, transistor 31 operating as current source A has its rate of change of current in respect to operating condition changes vary at a slower rate than current source B (transistor 32). Transistor 32 which is comparable to current source B of FIG. 2 does not have the feedback to reduce its slope of the response curve.

Therefore, transistor 32 changes at a faster rate (higher slope) to increase the current $I_b$ as it traverses from slower to faster conditions then compared to current $I_A$ of transistor 31. The resulting difference current $I_{diff}$ is the difference of $I_A$–$I_B$.

Resistor 36 is formed preferrably in gate level polysilicon since this material typically has a moderate temperature coefficient for low doping levels. With gate level polysilicon resistor, a good tracking of process variations, such as effective gate length of the transistor, is achieved. However, other techniques such as source/drain diffusion and CMOS well resistors can be used instead of the gate level polysilicon resistor. Further, in place of resistor 36 an active component, such as a transistor, can be used with equivalent effect.

Figure 5:
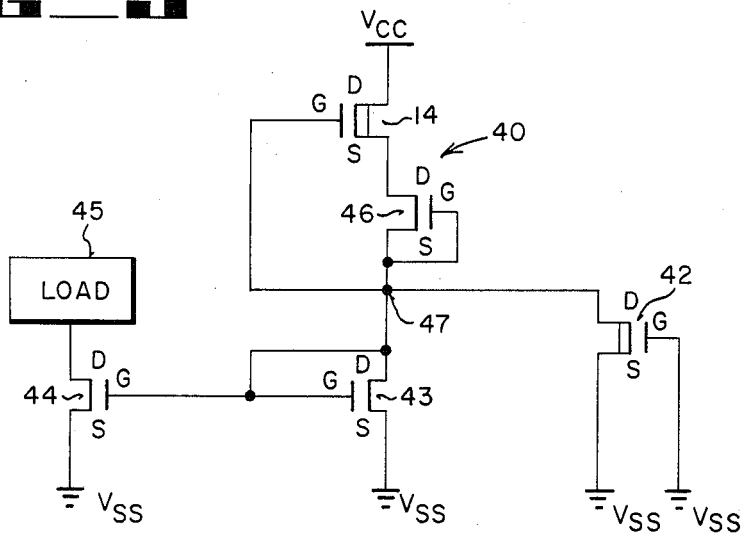
FIG. 5 is an alternative embodiment of the present invention using a depletion type transistor for the feedback element to the circuit shown in FIG. 4.

FIG. 5 shown such a circuit 40, wherein transistor 46 is used in place of resistor 36. Devices 41–45 are coupled and function equivalently to that of FIG. 4, but resistor 36 is replaced by depletion type transistor 46. Source of transistor 41 is coupled to drain of transistor 46 and source of transistor 46 is coupled to node 47 which is equivalent to node 37 of FIG. 4. Gate of transistor 46 is coupled to node 47 also.

Figure 6:
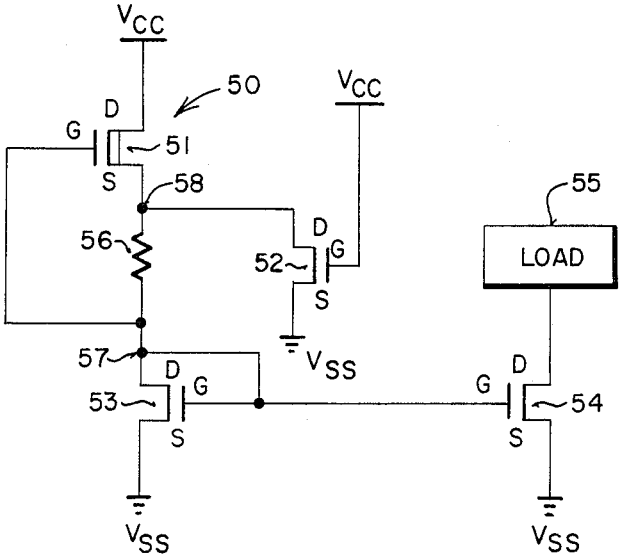
FIG. 6 is another alternative embodiment of the present invention, wherein a depletion type transistor is used for current source A, an enhancement type transistor is used for current source B and a resistor is used as the feedback means.

Referring to FIG. 6, another embodiment of the present invention is shown. Transistors 53 and 54 are coupled to operate as current mirror transistors to provide a compensating current to block 55. The coupling and functioning of devices 53–55 are equivalent to devices 23–25 of FIG. 3. Transistor 51 operating as current source A is a depletion device and has a resistor 56 coupled between nodes 58 and 57 to provide feedback to its gate. Current source B as depicted by transistor 32 of FIG. 4 has now been replaced by transistor 52. Transistor 52 is an enhancement device having its drain coupled to the source of transistor 51 at node 58 and its source coupled to Vss, which in this case is ground. Gate of transistor 52 is coupled to the supply voltage Vcc. Therefore, in comparing FIG. 5 to the circuit of FIG. 4, transistor 32 of FIG. 4 has been replaced by an enhancement type device in transistor 52 and its drain connection moved to the opposite side of the resistor at node 58 in FIG. 6.

Figure 7:
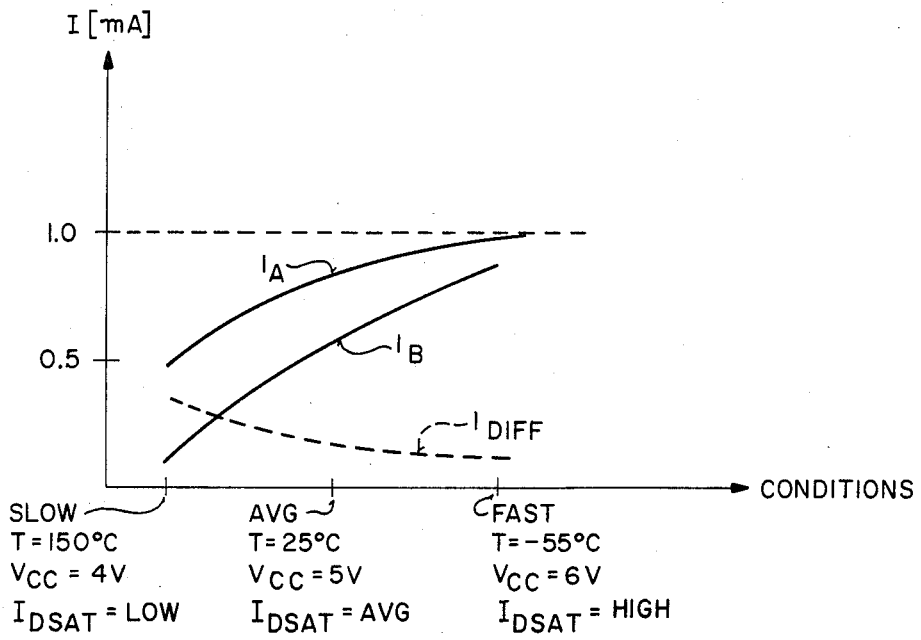
FIG. 7 is a graph showing a more realistic transistor response of current sources A and B and a difference of the two current sources; and also showing one example of values attributed to various operating conditions.

Referring to FIG. 7, a more realistic curve than that of FIG. 2 showing a response of the current sources of the present invention is shown. An example of typical values for one circuit, such as that shown in FIG. 4, is shown on the graph. The slowest conditions are shown at temperature of 150° C., Vcc equal to 4 volts and a low saturation current value. Fast end responses are that of temperature at minus 55° C., Vcc equal to 6 volts and a high saturation current level. A typical medium values are temperatures at 25° C., Vcc at 5 volts and an average or typical saturation current level. The current values are shown, wherein $I_A$ has a value of 0.5 mA at the slower end and 1.0 mA at the faster end. As was the case in the description of FIG. 2, the curve representing $I_{diff}$ has a negative slope which is equivalent to the difference of $I_A$–$I_B$.

Figure 8:
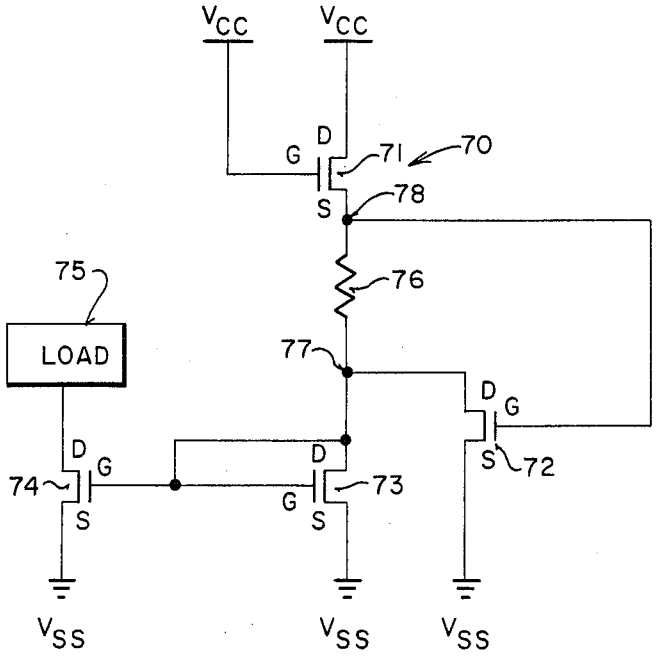
FIG. 8 is another alternative embodiment of the present invention, wherein only enhancement type devices are used and a resistor is used as the feedback means.

Referring to FIG. 8, another embodiment of the present invention is shown, wherein only enhancement (n-channel) devices are utilized. Again transistor 71 operates as current source A and transistor 72 operates as current source B. Transistors 73 and 74 operate as current mirrors to provide a compensating current to block 75 as was explained with the previous circuits. Resistor 76 is coupled between nodes 77 and 78 which are coupled to drain of transistor 73 and source of transistors 71, respectively. Current source B is represented by transistor 72 in this instance wherein drain of transistor 72 is coupled to node 77 and gate of transistor 72 is coupled to node 78. Source of transistor 72 is coupled to Vss, which in this case is ground. In this instance, resistor 76 provides feedback to transistor 72 such that in a graph of current verses transistor conditions, transistor 72 operates with a higher slope than that of transistor 71 as was described in reference to $I_A$ and $I_B$ of FIG. 2.

Although several embodiments of the present invention have been shown in various FIGS. 4–6 and 8, it is evident that other variations are available which perform an equivalent function. It is appreciated then that other circuits are available to perform the same function of providing a compensated difference current from two current sources without departing from the spirit and scope of the present invention. Although the present invention has been described in reference to MOS devices, which are typically manufactured in an integrated circuit chip, other techniques, such as the use of bipolar transistors, can be used to provide a current difference current source.

Thus a current difference current source is described.

We claim:

1. A circuit for providing a compensated current which is substantially independent of operating condition changes, comprising:

a first current source comprised of a first transistor and having a first current;

a second current source comprised of a second transistor and coupled serially to said first current source and having a second current;

a third transistor coupled serially to said first current source and parallel to said second current source for providing said compensated current, said compensated current determined by a difference of said first and second currents;

said first and second current sources having characteristics, such that said first and second currents vary as operating conditions change, but said difference remains approximately constant;

whereby a substantially uniform compensated current independant of operating condition variations is achieved.

2. The circuit of claim 1, wherein said first, second and third transistors are comprised of MOS transistors.

3. The circuit of claim 2, wherein said third transistor is coupled to a fourth MOS transistor to operate as a current mirror.

4. The circuit of claim 3, wherein said compensated current has a reverse compensation characteristic such that said difference decreases as said first and second currents increase due to changes of said operating condition.

5. A circuit for providing a compensated current which is substantially independent of operating condition changes, comprising:

a first transistor;

a second transistor coupled serially to said first transistor;

a third transistor coupled serially to said first transistor and parallel to said second transistor;

said compensated current is equivalent to a current flow through said third transistor and is determined by a subtraction of a second transistor current flowing through said second transistor from a first transistor current flowing through said first transistor;

whereby said compensated current is substantially uniform as said operating conditions change.

6. The circuit of claim 5, wherein said transistors are MOS transistors.

7. The circuit of claim 6, wherein said first and second transistors respond characteristically to that of typical MOS transistors, such that said first and second currents vary according to said operating condition changes, but said difference of said first and second transistor currents remain substantially constant.

8. The circuit of claim 7, including a fourth transistor coupled to said third transistor to function as a current mirror.

9. The circuit of claim 8, further including feedback means coupled to said first transistor for providing feedback, so that said first transistor current varies at a slower rate to said operating condition changes than said second transistor current, wherein said compensated current has a reverse compensation characteristic such that said difference decreases as said first and second transistor currents increase due to said operating condition changes.

10. The circuit of claim 9, wherein said feedback means is a fifth transistor.

11. The circuit of claim 10, wherein said first, second and fifth transistors are depletion type transistors and said third and fourth transistors are enhancement type transistors.

12. The circuit of claim 9, wherein said first and second transistors are depletion type transistors.

13. The circuit of claim 12, wherein said third and fourth transistors are enhancement type transistors.

14. The circuit of claim 9, wherein said feedback means is a resistor.

15. The circuit of claim 14, wherein all four transistors are enhancement type transistors.

16. The circuit of claim 14, wherein said first and second transistors are depletion type transistors and said third and fourth transistors are enhencement type transistors.

* * * * *